US005628666A

United States Patent [19]

Tomczyk et al.

[11] Patent Number: 5,628,666

[45] Date of Patent: May 13, 1997

[54] TOY BUILDING CHIP

[75] Inventors: John Tomczyk, Grand Prairie; Russell LaCoste, Collyville; Mark A. Celeste, Lake Dallas, all of Tex.

[73] Assignee: Pinnacle Brands, Inc., Grand Prairie, Tex.

[21] Appl. No.: 382,734

[22] Filed: Feb. 2, 1995

[51] Int. Cl.[6] ..... A63H 33/08

[52] U.S. Cl. ..... 446/125; 446/114

[58] Field of Search ..... 434/403; 40/454; 446/114, 108, 124.5

[56] References Cited

U.S. PATENT DOCUMENTS

| | | | |
|---|---|---|---|
| Re. 2,528 | 3/1867 | Hill | 434/403 |
| 4,869,946 | 9/1989 | Clay | 40/454 |
| 4,870,768 | 10/1989 | Watt et al. | 40/454 |
| 5,451,181 | 9/1995 | Denoux | 446/465 |

FOREIGN PATENT DOCUMENTS

| | | | |
|---|---|---|---|
| 132558 | 5/1949 | Australia | 446/114 |
| 990109 | 9/1951 | France | 446/124 |

OTHER PUBLICATIONS

Advertisement For Rings And Square Toy by Playplax® of England 1968 Toy Fair.

*Primary Examiner*—Max Hindenburg
*Assistant Examiner*—Pamela Wingood
*Attorney, Agent, or Firm*—Baker & Botts, L.L.P.

[57] ABSTRACT

The invention includes a chip of resilient material that is capable of being secured to one or more chips of similar design, as desired to build a structure, sculpture or other shape. The chip has one or more slots extending inwardly from its perimeter for engaging another chip of similar design. The slot may be used to engage a similar slot fashioned in another similar chip or to engage only the perimeter of another chip.

11 Claims, 1 Drawing Sheet

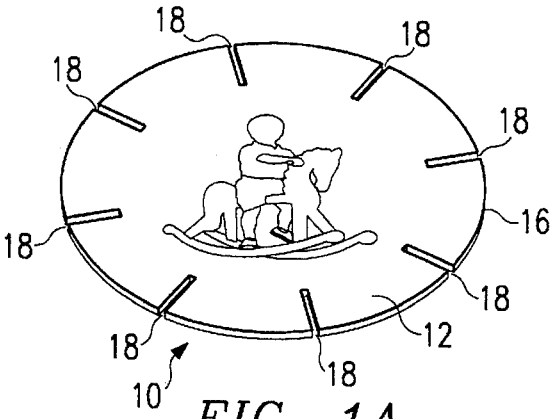
FIG. 1A
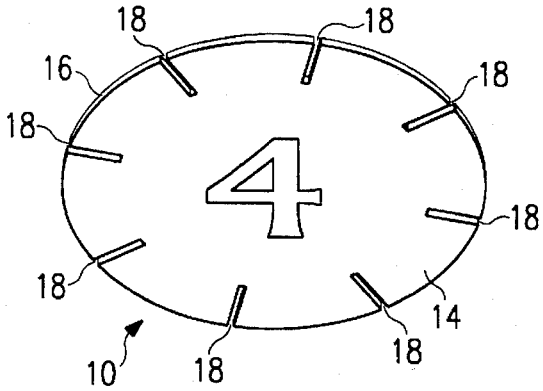
FIG. 1B
FIG. 2A
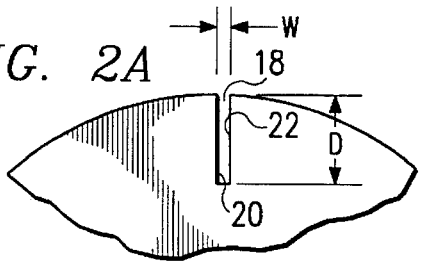
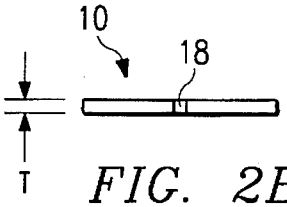
FIG. 2B
D=2T
W=T−.002"
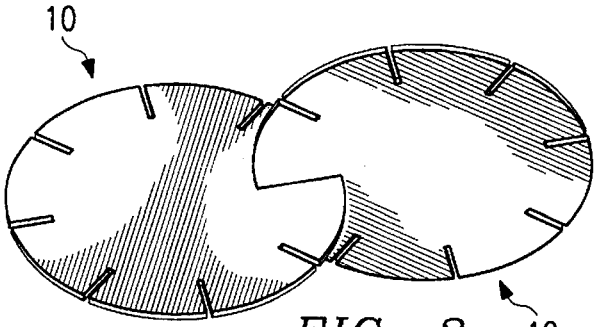
FIG. 3
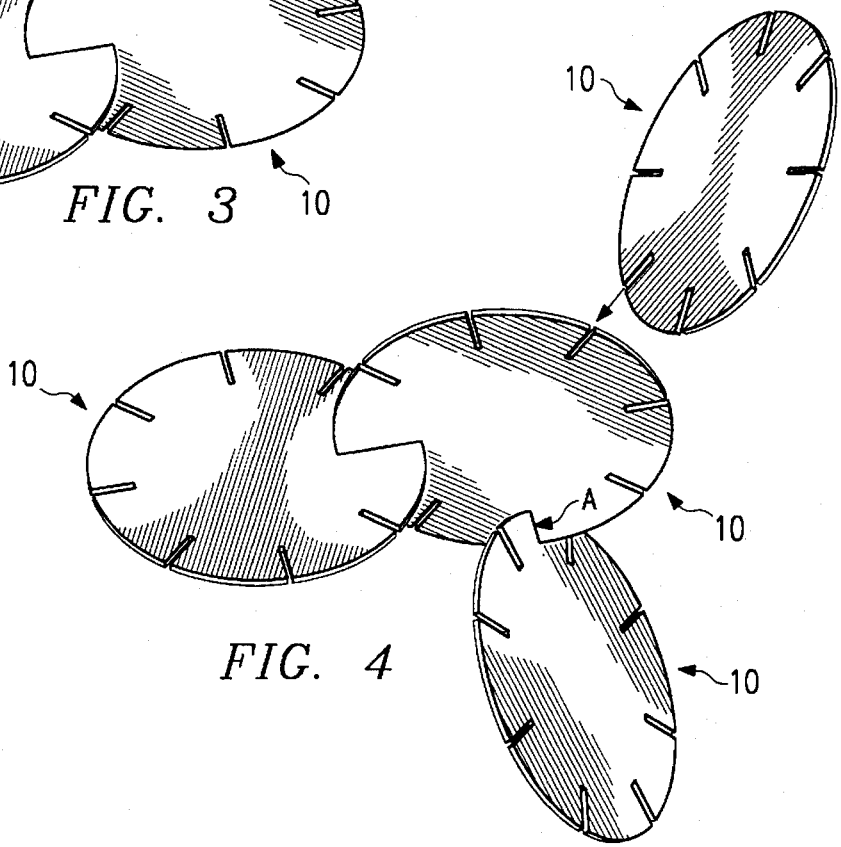
FIG. 4

TOY BUILDING CHIP

TECHNICAL FIELD

This invention relates to toy building components and, more particularly, to a disc that can be secured to other discs to create a structure.

BACKGROUND OF THE INVENTION

Popular amongst children is the milk cap game, sometimes known as "POG." The milk cap game utilizes a number of milk cap chips, which players seek to acquire through play. Milk cap chips are disc-shaped pieces of plastic or resilient paper that have different images or other indicia on each side. Often, one side of each of the chips displays a character or other image children or other players find delightful or interesting. On the other side often is found a number or other designation used in the identification and collection of chips.

Chips are obtained by striking a "slammer" on a stack of chips. Chips landing with the initially downward facing side facing upward are "won" and removed from play by the player throwing the "slammer." If a player wins one or more chips, that player takes another turn. Play passes to the next player if no chips are acquired.

The chips are used in the game of milk cap and as collectibles. The present invention adds additional dimensions to the variety of uses to which any chip may be put.

The invention generally includes providing milk cap chips with at least one notch extending inwardly from the periphery of the chip. Two or more of such chips may then be secured together by engaging the notch of one chip with an edge or notch of another chip. Preferably, the notch has a span across the chip perimeter substantially equivalent, but slightly less, than the thickness of the chip. This allows the notch of one or both chips to grip the surface of an adjacent chip with a friction fit. The number of notches in each chip may be increased to further increase the variety of available locations and angles at which other adjacent chips can be secured.

DESCRIPTION OF THE DRAWINGS

For a more complete understanding of the present invention and the advantages thereof, reference is now made to the following Detailed Description taken in conjunction with the accompanying Drawings in which:

FIG. 1A is a perspective view illustrating a chip comprising a preferred embodiment of the invention showing a first face of the chip;

FIG. 1B is a perspective view of the chip shown in FIG. 1A, illustrating a second, opposite face of the chip;

FIG. 2A is a partial front view of a chip incorporating the invention;

FIG. 2B is a partial top view of the portion of the chip shown in FIG. 2A;

FIG. 3 is a perspective view of two chips incorporating the invention secured together; and FIG. 4 is a perspective view illustrating the method of constructing a structure utilizing a number of chips incorporating the invention.

DETAILED DESCRIPTION

FIGS. 1A and 1B illustrate the two faces of a chip 10 incorporating a preferred embodiment of the invention. The chip 10 is preferably approximately one to two millimeters thick and manufactured from flexible, yet resilient, plastic or paper board. The chip 10 is circular in shape.

Face 12 of the chip 10 illustrates a rocking horse. It will be appreciated that other images, such as scenery, celebrities, sports figures, designs and the like might be used also. In the preferred embodiment shown, the face 12 is a "lenticular" surface, which displays two alternate rocking positions (second position not shown) of the rocking horse as the angle of the face 12 to the viewer is varied. It will be further appreciated that two or more alternate images, other than a rocking horse, could be utilized on the lenticular face 12.

FIG. 1B illustrates the second face 14 of the chip 10, bearing a numerical indicia "4." It will be appreciated that a number of chips 10 used in playing the milk cap game would have a variety of different numerical indicia on their faces 14, serving as a reference for collection purposes. While numerical indicia are shown on the face 14, other indicia might be used as well or as an alternative.

Positioned about the perimeter 16 of the chip 10 are preferably eight slots 18. The slots 18 extend radially from the center of the disc 10 and are each spaced from the immediately adjacent slots 18 by an equal distance. Thus, each slot 18 is positioned diametrically opposite one of the remaining slots 18 and at regular intervals around the perimeter 16 of the chip 10.

FIGS. 2A and 2B illustrate in more detailed the preferred width ("W") and depth ("D") of each of the slots 18. FIG. 2A is a magnified side view of a portion of the chip 10. Each of the slots 18 is preferably dimensioned as is shown in FIG. 2A. Specifically, the width W of each slot is preferably substantially equivalent, but slightly less (approximately 0.002 inches less) than, the thickness ("T") of the chip. FIG. 2B is a top view of the portion of the chip 10 shown in FIG. 2A, illustrating that the thickness T of the chip 10 is substantially equivalent, but about 0.002 inches more than, the width W of each of the slots 18. The depth D of each of the slots 18 is preferably approximately twice the overall thickness T of the chip. The opposing walls 20 and 22 of each of the slots 18 are preferably substantially parallel.

The width W and depth D of each of the slots 18 allows two or more similar chips 10 to be secured together, as Is shown in FIGS. 3 and 4. The chips 10 are easily secured together with a friction fit by first positioning the chips in a substantially perpendicular orientation to each other. Aligned slots 18 of the two adjacent chips 10 are then moved into engagement with each other, in a friction grip. The friction grip is caused by friction between the walls 20 and 22 of each of the slots 18 with that portion of the faces 12 and 14 of the adjoining chip 10 contacted by the slot 18. It will be appreciated that adjacent chips 10 need not remain oriented perpendicularly following engagement. In use, interconnected chips 10 may be rotated out of the perpendicular position, as desired, to some extent.

FIG. 4 illustrates that a larger number of chips 10 maybe secured together to form a sculpture or other shape desired. If desired, adjacent chips 10 may be secured together without mating together their slots 18. Instead, the slot 18 of one chip may be slipped over the perimeter of an adjacent chip 10, such as at a point of connection "A," to form a friction grip interconnecting the chips 10. This provides additional flexibility in the arrangement of interconnected chips 10. Shown by an arrow in FIG. 4 is the addition of yet another chip added to the arrangement, as a process of building a desired sculpture or other structure progresses.

Although preferred and alternative embodiments of the present invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

We claim:

1. A toy for creating a unique arrangement of cooperating pictorial and spatial elements, the toy comprising:

a first circular disc having a predetermined thickness, the first circular disc having at least one slot extending radially inward from the perimeter of the first circular disc, said first circular disc including first and second faces, wherein the first face comprises a lenticular surface alternatively displaying at least two images, depending upon the angle at which the first face is viewed;

a second circular disc having substantially the same predetermined thickness as the first circular disc, the second circular disc having at least one slot extending radially inward from the perimeter of the second circular disc; and the first circular disc and second circular disc secured together in any one of a plurality of arrangements by engaging a slot of the first circular disc with the second circular disc, the first and second circular discs are operable by the user to collectively form any one of a plurality of images when so engaged where each one of the plurality of images comprises a unique arrangement of cooperating pictorial and spatial elements.

2. The toy of claim 1, wherein the second circular disc includes first and second faces, the first face comprising a lenticular surface alternatively displaying at least two images, depending upon the angle at which the first face is viewed.

3. The toy of claim 1, wherein the second face of the first circular disc comprises a lenticular surface alternatively displaying at least two images, depending upon the angle at which the second face of the first circular disc is viewed.

4. The toy of claim 2, wherein the second face of the second circular disc comprises a lenticular surface alternatively displaying at least two images, depending upon the angle at which the second face of the second circular disc is viewed.

5. The toy of claim 1, wherein the second face of the first circular disc displays an indicia.

6. The toy of claim 1, wherein the second circular disc displays an indicia.

7. The toy of claim 1, wherein the first circular disc has a plurality of slots extending radially inward from the perimeter of the first circular disc.

8. The toy of claim 1, wherein the first circular disc has a plurality of equally spaced slots extending radially inward from the perimeter of the first circular disc.

9. The toy of claim 1, wherein the second circular disc has a plurality of slots extending radially inward from the perimeter of the second circular disc.

10. The toy of claim 1, wherein the second circular disc has a plurality of equally spaced slots extending radially inward from the perimeter of the second circular disc.

11. The toy of claim 1, wherein the first and second circular disks are secured together by engaging a slot of the first circular disc with a slot of the second circular disk.

* * * * *